United States Patent [19]

Walther

[11] Patent Number: 4,824,115

[45] Date of Patent: Apr. 25, 1989

[54] GOLF CLUB HEAD

[76] Inventor: Dieter Walther, 15 2nd Avenue, Orange Grove, Transvaal, South Africa

[21] Appl. No.: 96,394

[22] Filed: Sep. 11, 1987

[30] Foreign Application Priority Data

Sep. 14, 1986 [ZA] South Africa ..... 86/1902

[51] Int. Cl.[4] ..... A63B 53/04

[52] U.S. Cl. ..... 273/169; 273/173

[58] Field of Search ..... 273/169, 170, 171, 172, 273/173, 174, 78, 167 F, 167 J

[56] References Cited

U.S. PATENT DOCUMENTS

| | | | |
|---|---|---|---|
| 1,413,854 | 4/1922 | Kraeuter | 273/173 |
| 1,459,810 | 6/1923 | Wills | 273/169 |
| 1,646,461 | 10/1927 | Relle | 273/174 |
| 3,250,536 | 5/1966 | Moser | 273/169 |
| 3,578,332 | 5/1971 | Caldwell | 273/167 F |
| 3,966,210 | 6/1976 | Rozmus | 273/169 |
| 4,580,784 | 4/1986 | Brill | 273/169 |

*Primary Examiner*—George J. Marlo
*Attorney, Agent, or Firm*—Darby & Darby

[57] ABSTRACT

A golf club, preferably in the form of a putter has a head cast from a relatively light weight material such as an aluminium alloy. Cast within the head are center weights of a relatively heavy material such as brass, the weights being integral but extending on either side of the center of gravity of the head so that the mass of the weights increases with distance from the center of gravity towards the heel and toe of the head and decreases from the side of the striking surface of the club towards the rear thereof.

12 Claims, 2 Drawing Sheets

GOLF CLUB HEAD

INTRODUCTION TO THE INVENTION

This invention relates to golf clubs, particularly, but not exclusively to golf clubs having metal heads and of the type used for putting.

BACKGROUND TO THE INVENTION

Golf players, when hitting a golf ball, must ensure that the ball is struck by the club head at a position adjacent the centre of gravity of the club head, or the 'sweet spot' as it is known in the game. Failure in this regard causes the club head to turn at the point of impact and results in the ball travelling a shorter distance than would otherwise be achieved. In order to overcome this problem, 'heel' and 'toe' weights have been incorporated into golf club head. It will be appreciate that a 'heel' weight is located adjacent the stick end of the head while a 'toe' weight is located adjacent the end of the head remote from the stick. This has been found to overcome the problem of the club turning at the point of impact to a large extent, but has not overcome the problem of the ball travelling a distance less than if it had been struck adjacent the centre of gravity of the head.

It is accordingly an object of this invention to provide a golf club which at least alleviates the problems associated with the prior art clubs.

SUMMARY OF THE INVENTION

According to the invention a golf club head includes centre weights extending on each side of a plane perpendicular to the striking surface and top surface of the head and extending through the centre of gravity of the head towards the heel and toe thereof, the mass of the centre weights increasing progressively to a maximum with distance away from the plane through centre of gravity.

Further according to the invention the centre weights do not extend to the centre of gravity.

Still further according to the invention the centre weights extend up to about one third of the distance between the centre of gravity and the heel and toe of the club respectively.

Still further according to the invention the centre weights extend to, and form part of, the striking surface of the head.

Still further according to the invention the centre weights are integral with each other.

Still further according to the invention the mass of the centre weights decreases from the striking surface side of the head towards the rear thereof.

Still further according to the invention the club head includes heel and toe weights and the heel and toe weights are integral with their adjacent centre weights.

Still further according to the invention the club head is made of a cast material with the centre weights cast therein.

Still further according to the invention the relative mass of the centre weights is greater than that of the other material from which the club head is made.

Still further according to the invention the material of the centre weights is a brass and the material of the remainder of the club head is an aluminum alloy.

Still further according to the invention the club head is a head for a putter. The invention also provides a golf club including a head as defined.

BRIEF DESCRIPTION OF THE DRAWINGS

Embodiment of the invention are described, by way of example only, with reference to the accompanying drawings in which.

DETAILED DESCRIPTION OF THE DRAWINGS

Figure 1:
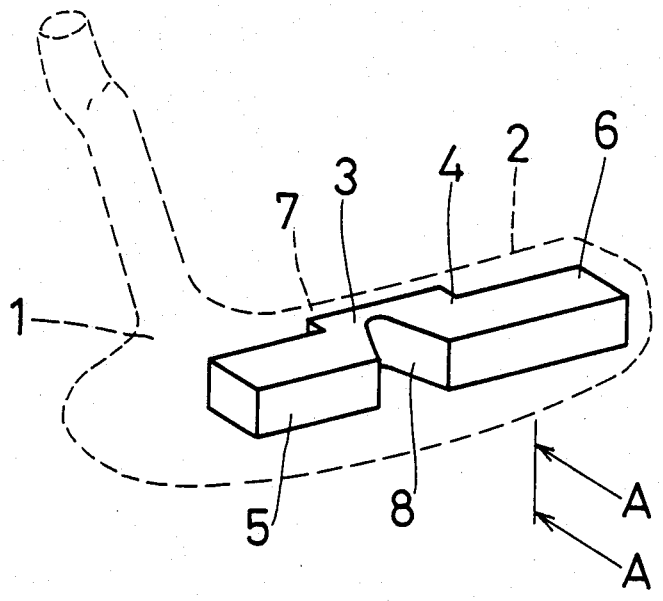
FIG. 1 is a perspective illustration of a golf club head having inserted weights.
Figure 2:
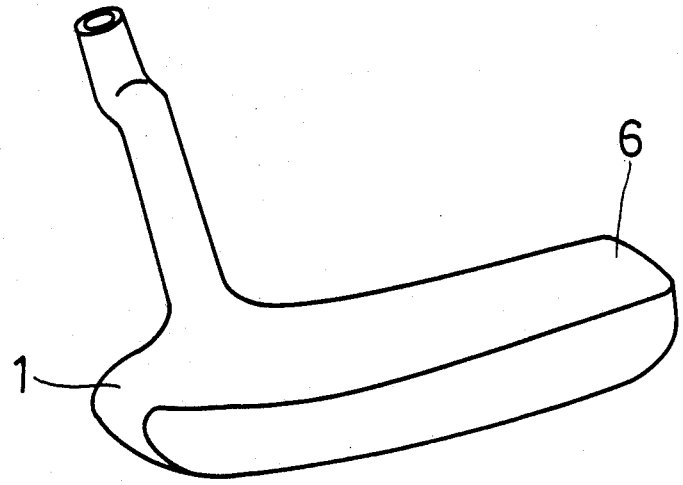
FIG. 2 is an illustration of the golf club head of FIG. 1.

In the first embodiment of the invention as illustrated by FIGS. 1 and 2 of the drawings a putter head 1 is cast from a light-weight aluminium alloy.

Cast within the head 1 and extending to the front striking surface 2 thereof is a pair of integral with heel and toe weights 5 and 6 respectively.

Both the centre weights 3 and 4 as well as the heel and toe weights 5 and 6 are made from a material in relative mas of which is far greater than that of the remainder of the club head. Conveniently this material may be a suitable brass.

The integral centre weights 3 and 4 are located on either side of the centre of gravity of the club head and are symmetrical about a plane (indicated generally by letters AA) which extends perpendicular to the front striking surface and top surface 7 of the club head 1 and passes through the centre of gravity 8 of the head.

The mass of the centre weights 3 and 4 increases with distance away from the plane through the center of gravity and decreases towards the rear or back of the club head. In this way the centre of gravity 8 is encompassed by or located in a space which is generally V-shaped when viewed from the top of the club head 1.

The integral centre weights 3 and 4 extend to the front or striking surface 2 of the club and form an integral surface therewith. This surface is basically rectangular in shape and is located approximately in the centre of the striking surface.

Insofar as the heel 5 and toe 6 weights are concerned it is to be noted that the toe weight 6 is about twice the size of the heel weight 5.

It has been found that while the heel and toe weights 5 and 6 contribute significantly to the prevention of turning of the head 1 about the point of impact with a golf ball when this is not directly opposite the centre of gravity 8 the inclusion of the centre weights 3 and 4 as defined aids in equalising the energy transmission to a golf ball should the position of impact be to the side of the centre of gravity 8. The golf ball will thus travel as far if struck at such a position all other factors being equal.

Figure 3:
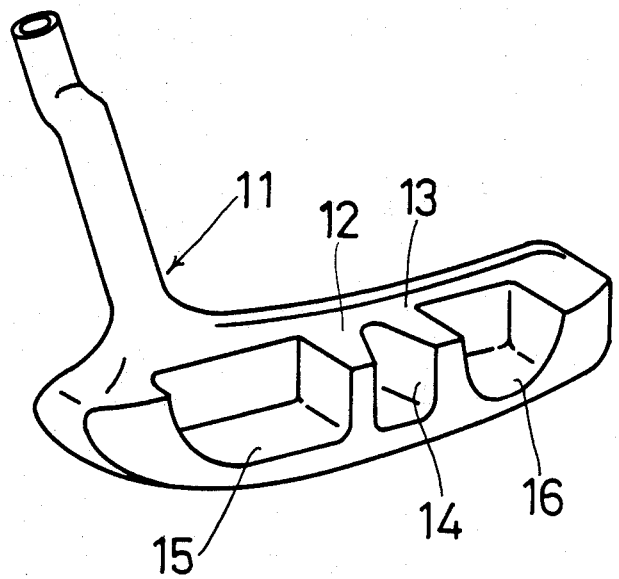
FIG. 3 is an illustration of a further embodiment of the invention.

An alternate embodiment of the invention is shown in FIG. 3.

In this embodiment a putter head 11 is cast from an aluminium material and instead of casting centre weights within the putter head 11 these centre weights 12 and 13 are simply formed in the material of the head itself by the removal of material from the head to give the required configuration. Thus a central area 14 is removed which corresponds to the centre of gravity of the head and heel and toe areas 15 and 16 are removed to define the limits of the weights 12 and 13.

Other embodiments are envisaged within the scope of the invention and include the application thereof to other golf club heads as well as other configurations and materials for the component parts.

What I claim as new and desire to secure by Letters Patent is:

1. A golf club head comprising a heel and a toe, a front striking surface and a top surface, a center weight the density of which is greater than that of the material from which the remainder of the club head is made, the center weight extending toward the heel and the toe and through and on each side of a plane substantially perpendicular to said front striking surface and said top surface and extending through the center of gravity of the club head with the mass of the center weight increasing progressively to a maximum with distance away from said plane extending through the center of gravity and with the center weight providing that part of the striking surface in front of the center of gravity and the mass of said center weight decreasing from the striking surface side of the head towards the rear thereof.

2. A golf club head as claimed in claim 1 in which the center weight extends up to one third of the distance between the plane through center of gravity and the heel and toe of the club respectively.

3. A golf club head as claimed in claim 1 which includes heel and toe weights.

4. A golf club head as claimed in claim 3 in which the heel and toe weights are integral with the center weight.

5. A golf club head as claimed in claim 1 which is made of a cast material with the center weight cast therein.

6. A golf club head as claimed in claim 1 in which the material of the center weight is a brass and the material of the remainder of the club head is an aluminium alloy.

7. A golf club head as claimed in claim 1 and which is the head for a putter.

8. A golf club head as claimed in claim 1 in which the center weight comprises a first and a second partial center weights, said first partial weight being integral with the heel and the second partial weight being integral with the toe of the club head.

9. A golf club head according to claim 8 wherein said first and second partial weights are located on either side of the center of gravity of the club head, symmetrically about the plane which extending substantially perpendicular to the front striking surface and a top surface of the club head and passes through the center of gravity of the head.

10. A golf club head according to claim 9 wherein the mass of the first and second center weights increases with distance away from the plane through the center of gravity and decreases towards the rear of the club head, so that the center of gravity of the head is located in a substantially V-shaped space when viewed from the top of the club head.

11. A golf club head according to claim 10 wherein the front striking surface is positioned opposite the angle of the V-shaped space.

12. A golf club head according to claim 9 wherein the first and second center weights extend to the front, striking surface of the club and form and integral surface therewith, said surface being substantially rectangular in shape and being located in an area of the center of the striking surface.

* * * * *